United States Patent [19]

Cermignani et al.

[11] Patent Number: 4,514,734

[45] Date of Patent: Apr. 30, 1985

[54] ARRAY ANTENNA SYSTEM WITH LOW COUPLING ELEMENTS

[75] Inventors: Justine D. Cermignani, Fort Salonga; Frederick M. Ganz, Nesconset, both of N.Y.

[73] Assignee: Grumman Aerospace Corporation, Bethpage, N.Y.

[21] Appl. No.: 468,878

[22] Filed: Feb. 23, 1983

Related U.S. Application Data

[63] Continuation of Ser. No. 149,019, May 12, 1980, abandoned, which is a continuation of Ser. No. 929,322, Jul. 31, 1978, abandoned.

[51] Int. Cl.[3] ..... H01Q 1/28; H01Q 21/08

[52] U.S. Cl. ..... 343/708; 343/815; 343/853

[58] Field of Search ..... 343/705, 708, 813, 815, 343/817–819, 833, 879, 853

[56] References Cited

U.S. PATENT DOCUMENTS

| | | | |
|---|---|---|---|
| 2,416,246 | 2/1947 | Wheeler | 250/11 |
| 2,452,073 | 10/1948 | Schivley et al. | 250/33.65 |
| 2,653,238 | 9/1953 | Bainbridge | 250/33.57 |
| 3,015,821 | 1/1962 | Bogner | 343/753 |
| 3,373,434 | 3/1968 | Lorenzo et al. | 343/879 |
| 3,508,278 | 4/1970 | Ehrenspeck | 343/819 |
| 3,560,975 | 2/1971 | Manuali | 343/705 |
| 3,742,513 | 6/1973 | Ehrenspeck | 343/817 |
| 3,858,221 | 12/1974 | Harrison et al. | 343/815 |
| 3,936,835 | 2/1976 | Phelan | 343/840 |
| 4,336,543 | 6/1982 | Ganz et al. | 343/705 |

*Primary Examiner*—Eli Lieberman

*Attorney, Agent, or Firm*—Morgan, Finnegan, Pine, Foley & Lee

[57] ABSTRACT

A scannable antenna array especially suited for aircraft having a common reflector and a plurality of spaced apart end-fired Yagi type elements each comprising a driver and one or more director segments spaced mutually from each other and the driver in the direction of the field pattern for the array. In the preferred embodiment, the driver is a dipole comprised of two laterally extending hooked-back radiating segments so dimensioned and spaced from the director elements so as to minimize the mutual electromagnetic coupling among elements of the array. In other embodiments, the driver may comprise a slot.

25 Claims, 9 Drawing Figures

ARRAY ANTENNA SYSTEM WITH LOW COUPLING ELEMENTS

BACKGROUND OF THE INVENTION

This is a continuation of application Ser. No. 149,019 filed May 12, 1980, which in turn is a continuation of application Ser. No. 929,322 filed July 31, 1978, both abandoned.

This invention relates to an array antenna system and in particular to an antenna system having high directivity with low antenna array side lobes over large scan angles and having improved power transfer characteristics in the electronic scan mode.

The effectiveness of a directional antenna system is influenced not only by its directional gain but also by its directional selectivity. No matter how sensitive the antenna along its beam axis, its effectiveness can be spoiled by unwanted reception off the beam axis. In radar applications, for example, target visibility is reduced by ground reflections (clutter) and (in military uses) jamming signals that are received through the antenna array side lobes.

It is known that the propagated radiation pattern of an antenna element is governed in part by the current distribution along the length of the excited antenna element. In some early attempts to improve directionality of the antenna and to suppress unwanted side lobes, the current distribution over the entire antenna area was made to decrease in conformity with a definite law from a maximum at the center toward the edges of the radiator. To do this, several radiating conductors were offset relative to the lateral axis of symmetry in order that currents in the elements were additive along lines parallel to that axis. Only a few current carrying elements were offset sufficiently to extend toward the far edges whereas all elements had a portion of their surfaces cut by the axis of symmetry.

Antenna technology has progressed significantly since that approach in the 1940's (see U.S. Pat. No. 2,354,254); nevertheless, the design of antenna systems continues to present difficult requirements, since compromises must often be made among gain, propagation pattern, bandwidth, scanning adaptability and impedance matching, to name only some of the factors which must be considered. The use of multiple antenna elements in an array provides improved directivity and gain of the antenna system and can be adapted to electronic scanning wherein the beam axis is scanned by controlling the phase of the radio signals used to excite the individual antenna elements. Thus, antenna arrays can meet some of the requirements not easily satisfied by non-arrayed systems.

Antenna arrays, however, present problems of their own. Preferably, the individual elements of the array should be as closely spaced as possible, consistent with the desired gain and directivity of the beam, to maintain the compactness of the system. In any array, on the other hand, it is difficult to avoid interelement coupling, since radiation from one element of the array tends to be received by and coupled into adjacent elements. This interelement coupling has a substantial impact on the radiation pattern.

An antenna array pattern consists of a main lobe and sidelobes resulting from the summation of the individual patterns produced by the individual radiating elements plus an array factor controlling the manner in which the entire array is excited. Specifically, the theoretical far-field radiation pattern of an antenna array is the sum of the separate contributions of the several element antennas making up the array, with the relative phases of the contribution in the far field being taken into account in the summation. Under certain circumstances, which may be assumed to be satisfied here for purpose of discussion, an antenna array pattern may be represented as the product of an array factor and the element pattern. (The required circumstances are that the elements be identical, that their generator impedances be identical, that the mutual energy interaction between each element and its neighboring elements extend over a region which is small compared with the overall size of the array so that the edge effects are relatively small, and that the elements other than those at the edges all see almost the same environment of neighboring elements, as would be the cases when the elements are uniformly spaced on a plane.) The array factor describes an antenna pattern which would be produced by a hypothetical antenna array consisting of isotropically radiating antenna elements whose phase centers are located at the phase centers of the elements of the actual array.

In practice it has been found that the in-array element patterns have more effect on the achievable performance of the net antenna array pattern than does the array factor itself. Thus, no matter how well laid-out the array, its performance can be seriously limited by a poor or unacceptable in-array element pattern wherein dissimilarity is present from one element to the next. A major cause of such dissimilarities between individual element patterns is the mutual coupling phenomenon whereby radiation from adjacent driven elements is picked up and re-radiated. When this phenomenon is present, unwanted sidelobes are produced.

For antennas adapted for airborne applications, it is desirable to be able to scan the antenna over a 90° quadrant, thus enabling the entire azimuth range to be covered by four antenna arrays: one fore, one aft and one at each side of the aircraft. However, in an electronically scanned array, the apparent impedance seen at the element input terminals varies in accordance with the beam pointing direction and the interelement coupling. The greater such coupling the less effective the antenna becomes because of the mismatch and resulting reflections emanating therefrom. When transmitting, the impedance mismatch limits power transfer. Where the mismatch is great, power reflected back to the transmitter can be excessive. Moreover, if the impedance changes as a function of scan angle, then transmitted (or received) power will likewise vary as a function of scan angle, thus giving rise to pattern irregularities during scanning. On receive, the apparent impedance mismatch results in received signals being reflected back into space by the antenna. In either case, both antenna pattern and power gain (or efficiency) are adversely affected.

In order that the antenna array present a uniform impedance and exhibit radiation uniformity, it is desirable (if not prerequisite) that the in-array element pattern have a smooth contour and that its relative gain be substantially constant over the scanning angles to be serviced. It is difficult to obtain a scannable, uniform pattern, particularly when scanning over wide angles of 90° and greater. Nevertheless, this radiation uniformity can be obtained, and is obtained in the present invention, by substantial elimination of the interelement coupling between the drivers of adjacent antenna elements.

As used herein, "interelement coupling" or "mutual coupling" refers to the radiation received (but not reflected) by an adjacent transmitting element (driver).

In the past, reduction or elimination of the interelement coupling has been sought by the placement of metal septa between elements to block or inhibit energy transfer between such elements. These septa form metal planes extending from the reflector (in the Yagi array) to the forward director. The use of such metallic septa between elements is not an acceptable solution to the problem for several reasons. First, they severely restrict the antenna system scan angle by presenting ground planes to all radiation except over very narrow main lobe beam angles. Additionally, they are subject to misalignment which, in turn, introduces nonuniformity of element patterns and impedance mismatch, and they present power drain.

Accordingly, principal objects of the invention are to obtain superior performance from an antenna array system without the disadvantages of the prior art systems, and to provide a scanning antenna array system having low sidelobes in both the electronic and mechanical scanning modes.

Other objects of the invention are to provide an antenna array system having low mutual electromagnetic coupling between individual antenna elements and having smooth antenna in-array element patterns, improved power transfer characteristics when electronically scanned, and relatively high and uniform gain over a finite bandwidth.

Yet another object is to provide an antenna system suitable for aircraft use and scannable over a total angle of about 90° with excellent gain uniformity throughout the scanning range, and which is particularly adapted to low profile configurations for installation in leading and trailing edge airfoils.

SUMMARY OF THE INVENTION

In general, the foregoing objects and advantages are obtained by configuring and locating the drivers, and preferably the directors, of an array of Yagi type antenna elements so as to minimize the mutual radiation coupling between adjacent drivers. In its simplest form, the antenna comprises a linear array of end-fire elements, each including a reflector, a Yagi driver and at least one parasitically activated director. In the preferred embodiment, the driver is a dipole having a pair of coplanar radiating conductors comprised of forward segments perpendicular to the Yagi axis (parallel to the reflector plane) and shorter, inwardly turned end segments parallel to the forward segments and so dimensioned that the tips of the end segments are mutually facing, whereby radiation from the tips tends to cancel and whereby radiation from the forward segments tends to be concentrated at the axis of the driver.

Preferably, for substantially complete elimination of interdriver mutual coupling, the first directors are so spaced and dimensioned in the array that they re-radiate onto adjacent drivers at an intensity and at a phase substantially canceling any direct radiation coupled into adjacent drivers from the excited driver. In alternative embodiments, slot radiating elements, which are the magnetic complement of the electrical dipole, may be used in place of the dipole driver and reflector ground plane.

Reference is now made to the following detailed descriptions of preferred embodiments, taken in conjunction with the accompanying drawings.

DESCRIPTION OF THE DRAWINGSS

FIG. 1*a* shows schematically in plan view a conventional array of end-fire elements of the Yagi variety in which each element contains a driver, two parasitic directions and a reflector common to all elements;

FIG. 1*b* is a side elevational view of the FIG. 1 antenna array;

FIG. 1*c* is the desired electronic scan angle of the antenna array of FIG. 1 in the E plane;

Figure 1A:
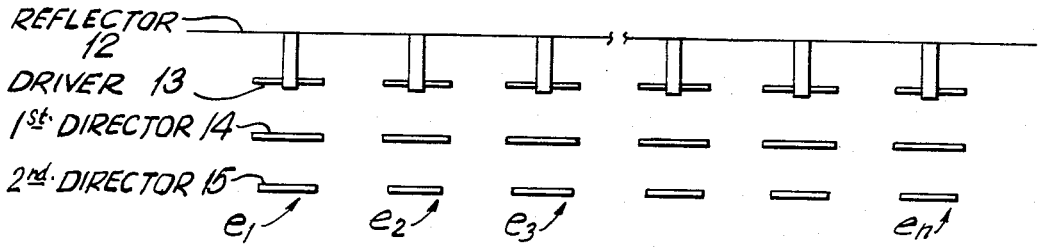
FIG. 1a PRIOR ART
Figure 1B:
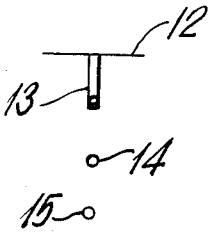

FIGS. 1*a* and 1*b* show diagrammatically the prior art configuration of a typical array of Yagi end-fire elements wherein each element $e_1$, $e_2$, $e_3 \ldots e_n$ contains a reflector 12 forming a ground plane common to all elements; a driver 13, and first and second directors 14 and 15, respectively. This array can produce maximum directivity in the end-fire element direction (perpendicular to the reflector 12) or can be electronically scanned in the plane of the array to produce maximum directivity at some other angle. The dimensions and positions of the directors relative to each other and to the drivers are selected to produce radiation cancellation in the back direction and reinforcement in the forward direction. There is also substantial radiation in the lateral direction (parallel to the reflector) owing in part to the inherent property of the dipole to radiate from its tips. However, the radiation is coupled to adjacent drivers also and distorts the ideal in-array element radiation patterns of the adjacent drivers, particularly when the array is being electronically scanned, for in that case the array is not being symmetrically driven.

As stated above, this in-array element pattern distortion results in dissimilarities which combine to produce substantial sidelobes in the far-field pattern. It is these sidelobes which reduce target visibility by radar by reason of ground reflections (clutter) and jamming signals, these unwanted signals being received through the antenna array sidelobes. The antenna array of the present invention virtually eliminates sidelobes from this effect by substantially reducing the interelement mutual coupling.

Figure 2:
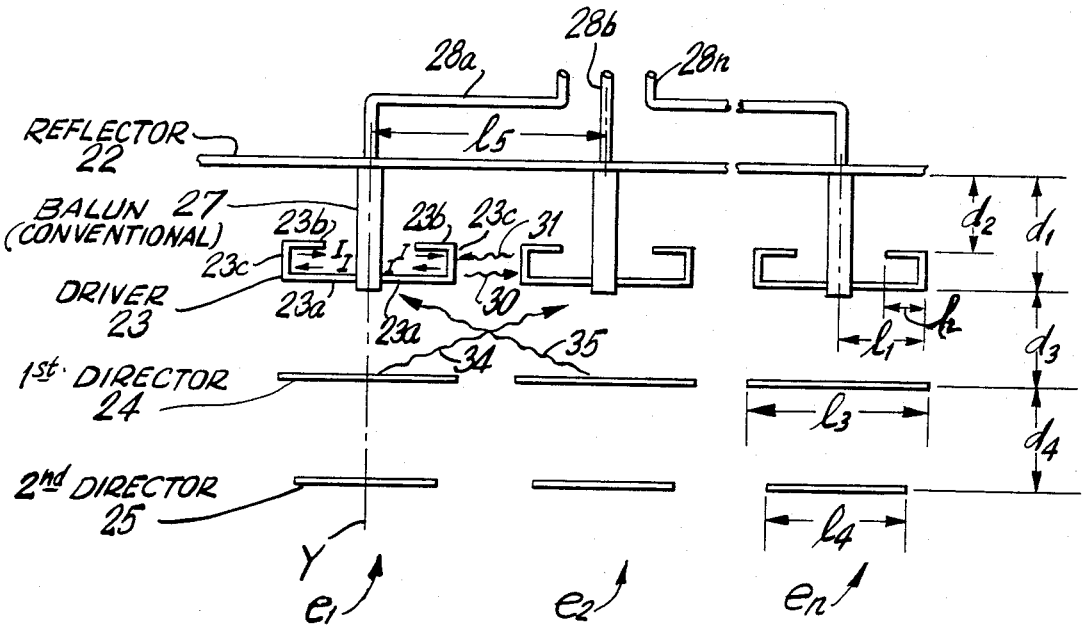
FIG. 2 is a schematic plan view in the E plane of an antenna array of end-fired Yagi elements according to the invention.

FIG. 2 depicts an array of Yagi type end-fired antenna elements constructed in accordance with the invention to effectively eliminate the mutual coupling effect discussed above. The antenna comprises a common planar reflector 22 similar to that shown in FIG. 1*b* and a linear array of Yagi elements each having a dipole driver 23, a first director 24 and a second director 25 mutually spaced forward of the driver. As in the case of the known array depicted in FIG. 1*a*, all of the Yagi elements in the array are in a common plane.

Figure 1C:
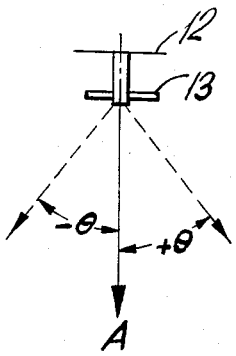

The drivers are supported forwardly of the reflectors on conventional baluns 27 which extend from the reflectors, and the RF signals exciting the array are fed through coaxial cables 28*a*, 28*b* . . . 28*n*. The baluns may be slotted and fitted with a metal sleeve which may be slid along the balun axis over the slots to achieve fine impedance matching between the transmitter/receiver (not shown) and the driver/director combination. In an electronically scannable array, the coaxial cables are connected to beam steering circuits (not shown) which, for example, modify the phases of the RF signals at their inputs in a predetermined manner so as to sweep the main lobe of the array from side to side over the scan angle $\pm\theta$ (See FIG. 1*c*) relative to the array normal axis A.

It has been found that, by configuring the dipole driver elements as shown in FIG. 2, the mutual coupling between adjacent driver elements can be significantly reduced, to a level where any energy coupled into the unexcited driver is substantially precluded by a properly tuned first director 24. Tuning is accomplished by locating and dimensioning the director to achieve the desired reduction in coupled energy. Each driver comprises a pair of symmetrically arranged radiating conductors having a forward radiating segment 23*a* extending from the balun 27 generally perpendicular to the Yagi axis (and parallel to the reflector-ground plane), a shorter inwardly turned end segment 23*b* behind the forward segment 23*a* and parallel thereto and a small intermediate transitional segment 23*c*.

As is well known, energy emitted by the driver of an end-fired Yagi element parasitically excites the directors, which are located so that re-radiation from the director reinforces the radiation from the driver in the main direction of propagation.

In Yagi arrays, a second and unwanted radiation path occurs laterally between adjacent drivers. This radiation is shown in FIG. 2 by the wavy arrows 30, 31. Dipole elements tend to radiate appreciably from their tips and thus, as is apparent from FIG. 1*a*, radiation from the tips of conventional drivers is directed at an adjacent driver.

In the array of FIG. 2, the inter-driver coupling (represented by the radiation arrows 30, 31) is significantly cut down, first by virtue of the facing, generally coaxial relationship of the dipole segments 23*b* and, second, by virtue of the concentration of radiation from the driver in the region near the Yagi axis Y (this axis being along the center line of the balun). More particularly, since the tips of end segments 23*b* face each other and are equidistant from the axis Y, the radiation from the dipole tips, a major offender in the prior art arrays, is inwardly directed, of opposite phase and thereby is partially canceled. In addition, because the current I distributed over segment 23*b* produces radiation 180° out-of-phase with the radiation produced by current distributed in segment 23*a*, the net apparent forward radiation from the outer extremities of the segment 23*a* is reduced and there is accordingly a tendency for the net radiation to be concentrated near the driver axis. That is to say, the amplitude of radiation emanating from the driver axis is greater relative to the amplitude of the radiation emanating from the ends of the driver at the extremity of segment 23*a*. Both of these effects serve to reduce the strength of the radiation field closest to adjacent drivers.

Figure 3:
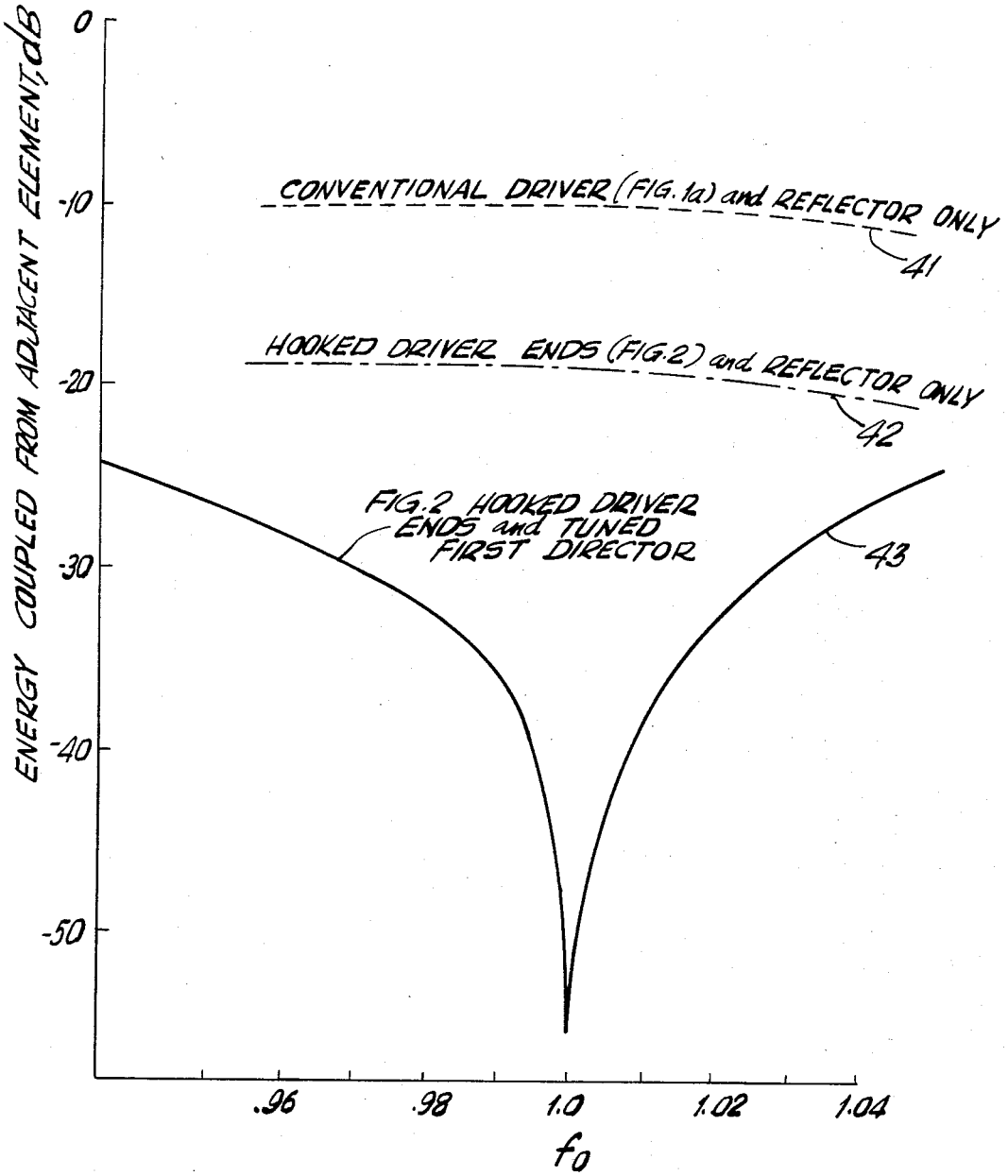
FIG. 3 is a series of graphs plotting the interelement energy coupling between adjacent elements of the FIG. 1 and FIG. 2 arrays as a function of frequency.

FIG. 3 indicates graphically the degree of interdriver coupling with the conventional driver and reflector of FIG. 1*a* and the improved hooked driver configuration illustrated in FIG. 2. The first graph 41 plots energy coupled to the driver adjacent the driven element in the prior art array. The coupled energy is at approximately −10 dB over the frequency range $0.96f_o$–$1.04f_o$ where $f_o$ is the desired center operational radio frequency. Graph 42 reveals that a truly substantial reduction in the coupled energy is achieved with the hooked-end driver configuration of FIG. 2, with the same linear spacing of Yagi elements. It will be seen that coupled energy is reduced to about −18 dB to −20 dB. This reduction by itself mitigates the in-array element pattern dissimilarity and pattern distortion. Moreover, it was found that when the interdriver energy coupling is maintained below about −15 dB, and particularly below −18 dB, the coupled energy can be essentially eradicated by tuning of the first director.

Referring again to FIG. 2, the wavy arrows 34, 35 represent radiation emitted from rod first directors 24 of elements $e_1$, $e_2$ to the drivers 23 of adjacent elements $e_1$, $e_2$. Each first director is placed and dimensioned such that when excited by its associated driver, it re-radiates energy which, as received by an adjacent driver, is approximately 180° out of phase electrically with, and approximately equal in amplitude to, the radiation coupled from one driver to the next. In other words, the driver of element $e_2$ receives radiation from element $e_1$ from two primary paths: the first path is schematically shown by the arrow 30, the second by the arrow 34. Radiation picked up by the driver of element $e_2$ via these two paths is made to be electrically opposite in phase and substantially equal in intensity, thereby tending to cancel out. When this result is obtained, the first director is said to be "tuned" to the driver.

In this manner, each element produces not only the desired in-array pattern in the far field but also self-canceling radiation at adjacent elements. Since this self-canceling coupled radiation is virtually independent of the excitation of adjacent elements, the interelement mutual coupling remains at a low level irrespective of the phase or intensity of the RF signal applied to adjacent elements during electronic scanning.

The dramatic reduction in interelement coupling in the presence of tuned rod directors is readily apparent in graph 43 of FIG. 3. At the center frequency $f_o$, interelement coupling is down by −55 dB as compared with −10 dB in the prior art array. Even at $0.96f_o$ and $1.04f_o$, coupled energy is down by approximately −28 dB. This minimal interelement coupling achieves the described smoothness in the in-array element patterns, as is evident in the measured in-array element pattern of FIG. 4. The radiation field ripple is only ±0.1 dB between ±30° relative to the Yagi axis, and is diminished by only 1 dB at ±45°. Moreover, the pattern has no secondary lobes and is smooth from 0° to ±90°.

Another measure of the foregoing performance is the small degree of impedance variation obtained with the tuned array of the invention. This result is shown qualitatively in the Smith chart of FIG. 5 which plots characteristic impedance as a function of scan angle for the antenna array of FIG. 2 and for a conventional array of the type shown in FIG. 1. Using an array with a conventional dipole without tuned directors (FIG. 1), the resistance component (R/Zo) of the load varied between about 0.93 and 0.5 while the reactance component (jx/Zo) changed progressively from about +0.6 to about −0.5 as the antenna was scanned from 0° to 50°. This result can be seen in plot (a). By way of contrast, the antenna array of the invention, plot (b), yielded only minimal impedance changes, with the resistance component changing from 1.0 at zero scan angle to only 0.93 at the maximum scan angle, Similarly, the reactance component of the impedance ranged between about ±0.15 from 0° to 60° scan angle.

Figure 4:
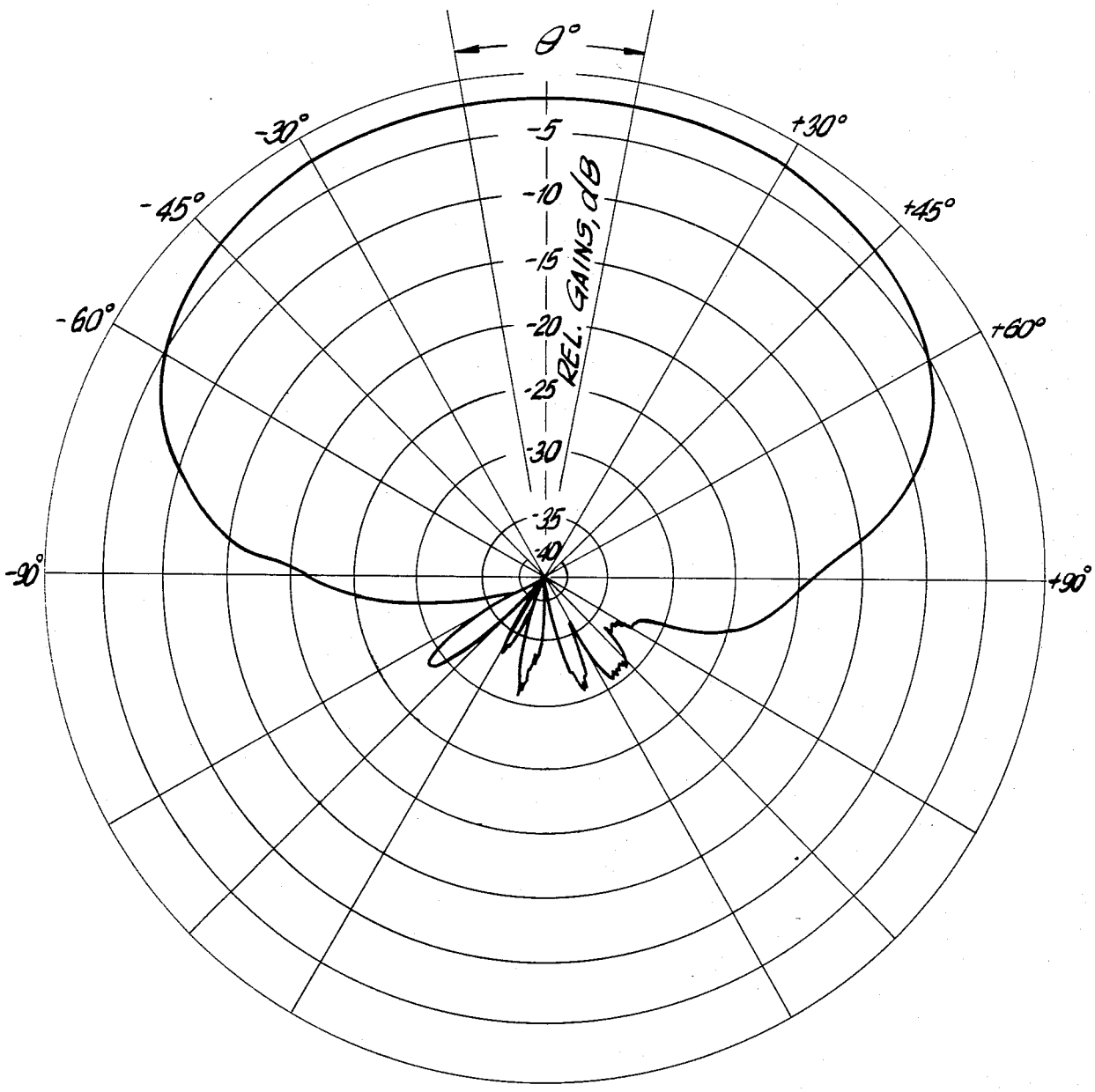
FIG. 4 is a polar diagram of the in-array element pattern in the E plane of the FIG. 2 antenna array.
Figure 5:
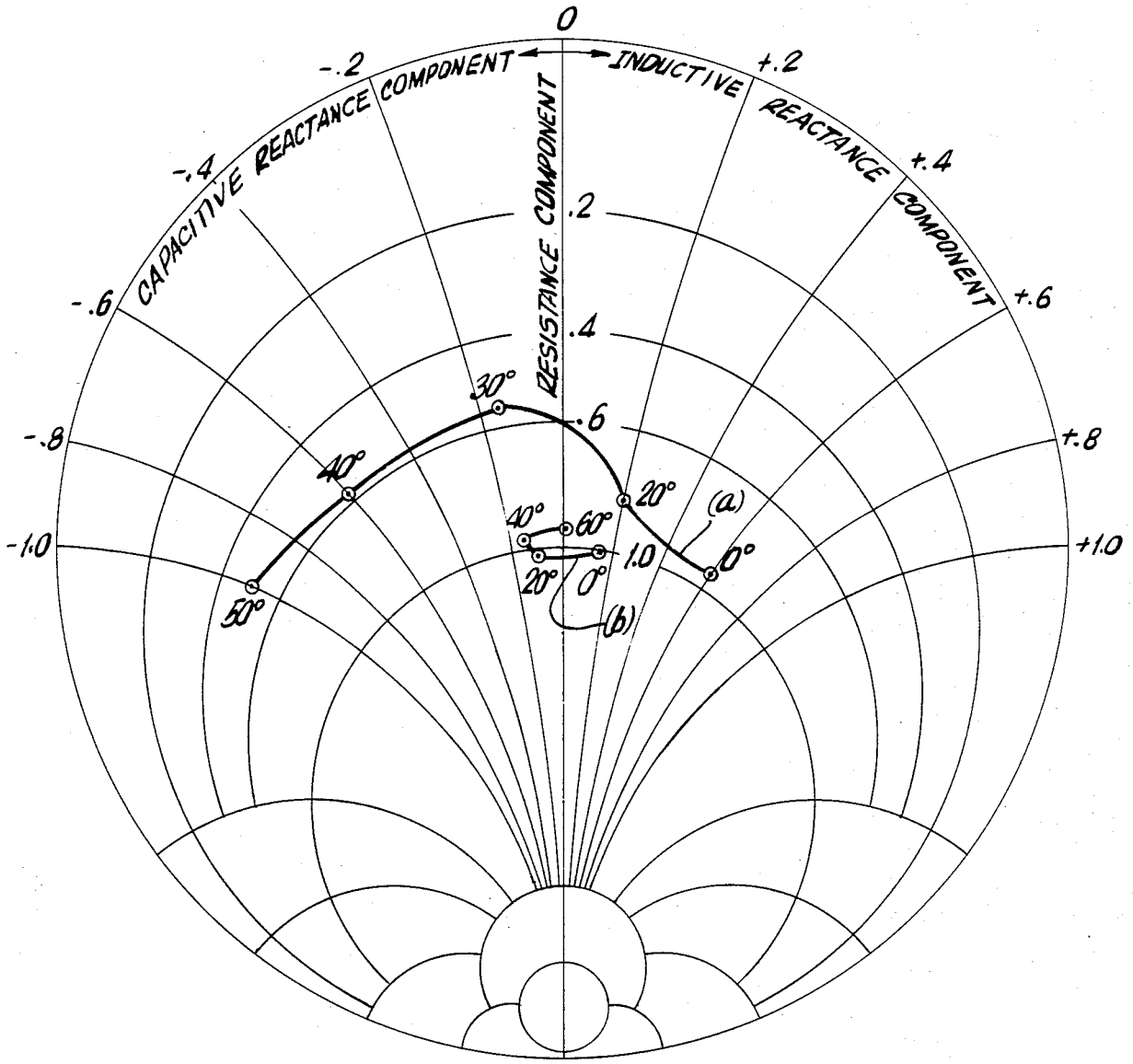
FIG. 5 is a Smith chart plotting the impedance of antenna elements using (a) a conventional dipole antenna array, and (b) the antenna array of the invention.

The results of FIGS. 3–5 were obtained with the FIG. 2 array, with the components dimensioned as follows, referring to the element $e_n$ in FIG. 2:

Driver 23

Distance $d_1$ from reflector to radiating segment 23a: 0.202λ.

Distance $d_2$ from reflector to inwardly turned end segment 23b: 0.14λ.

Length $l_1$ from center line of balun (Yagi axis) to end of forward radiating segment 23a: 0.177λ.

Length $l_2$, of inwardly turned segment 23b: 0.07λ.

Total length of segments 23a, 23b and 23c of each conductor 23 (approx.): 0.31λ.

First Director 24

Distance $d_3$ between radiating dipole segment 23a and director 24: 0.202λ.

Length $l_3$ of conducting director 24: 0.396λ.

Second Director 25

Distance $d_4$ between director 24 and director 25: 0.246λ.

Length $l_4$ of conducting director 25: 0.35λ.

Miscellaneous

Diameter of all radiating elements (driver and directors): 0.01λ. Spacing $e_5$ (balun-to-balun) of adjacent Yagi elements: 0.54λ.

Source impedance Zo: 50Ω.

Best overall performance of the system was achieved when the elements were spaced and dimensioned as above. Specifically, the antenna array exhibited the minimum interelement coupling (FIG. 3) and the least impedance variation (FIG. 5) over the operative desired scanning angle of ±45°.

As noted earlier, it is desirable to restrict interelement spacing to about ½λ. For scan angles of 90°(±45°) best performance was achieved with an interelement spacing of 0.54λ. To achieve these dimensions, it is desirable to restrict the total length of dipole radiating conductors 23 to less that ½λ so as to preserve adequate spacing between adjacent drivers. In the present invention, it is possible to use the optimum element spacing and still obtain the desired current distribution in the radiating segment 23a because the effective current distribution is controllable by adjusting the length of the inwardly turned end segments 23b of the driver.

The directors will, of course, not exceed ½λ. The intermediate driver segment 23c should be restricted to lengths substantially less than ¼λ in order to minimize radiation from this segment. Generally speaking, the director parameters (length and spacing) are determined empirically in order to obtain the cancellation effect at the adjacent drivers.

In applications where the driving element is not a dipole, but rather a slot radiator, a similar beneficial reduction in inter-element coupling is obtained with a single director located in front of each slot radiator, and so positioned and of a length to cancel the direct energy transfer from one slot radiator to the next. As is understood by those in the art, the slot radiator, or driver, comprises a metal-walled cavity, usually rectangular, measuring ¼λ deep and approximately ½λ long. Typically, the radiating conductor is located at one side of the ½λ-long cavity to reduce impedance and is oriented perpendicularly to the long side. Spacing between adjacent slots would be approximately ½λ. The slot driver is especially useful in applications providing sufficient space for accommodating the ¼λ slot cavity depth.

Figure 6:
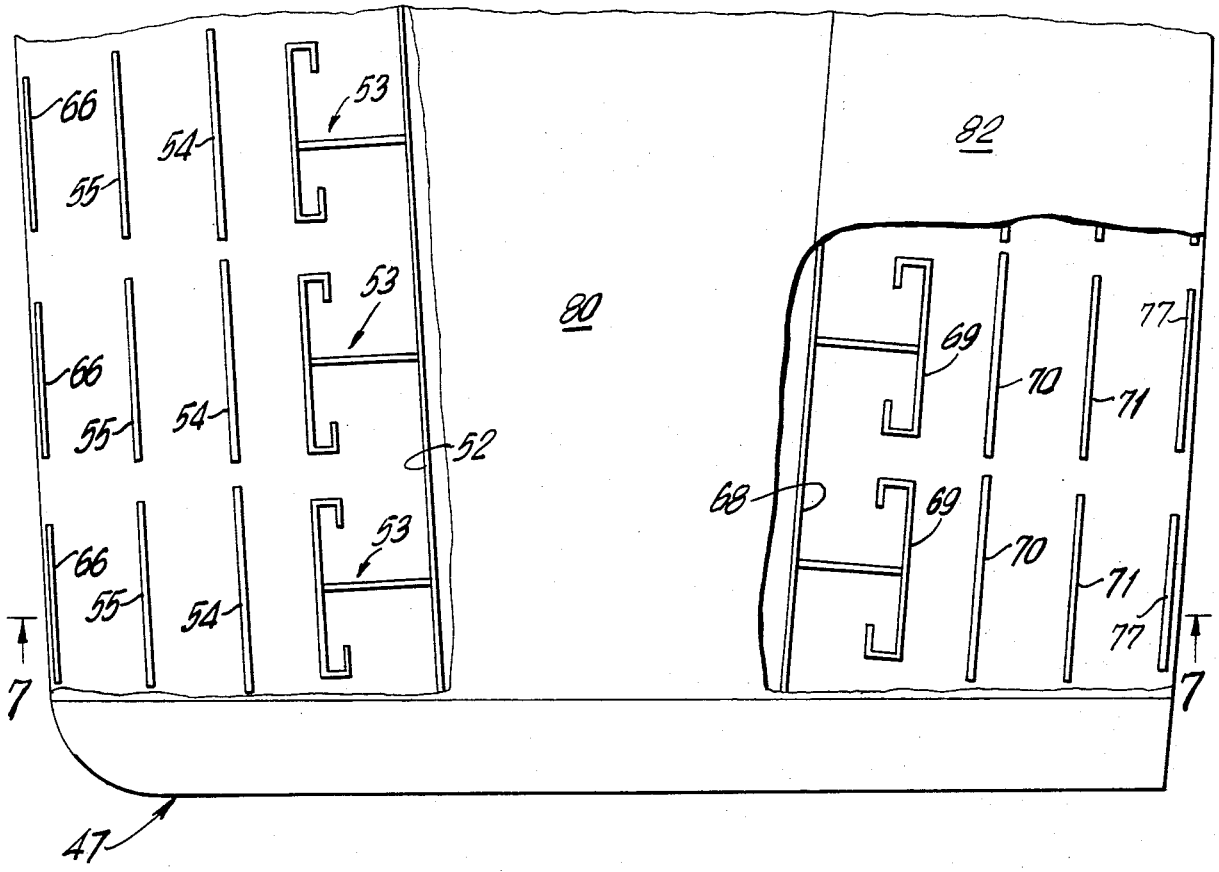
FIG. 6 is a cut-away plan view of the end portion of an airplane wing showing the disposition of the antenna system of the invention for airborne applications.
Figure 7:
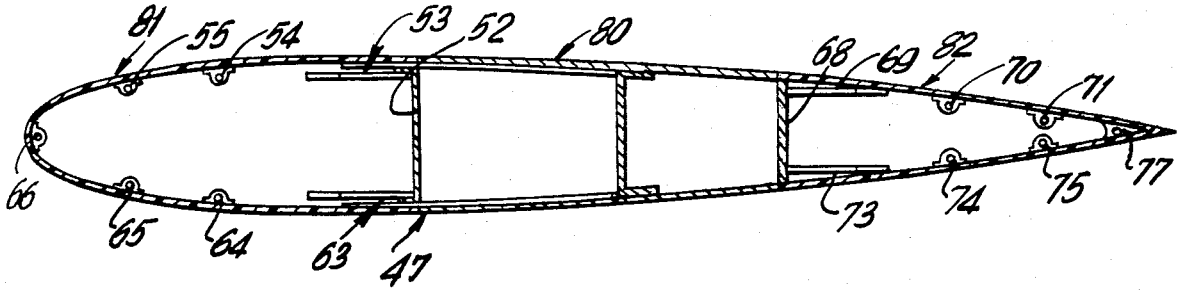
FIG. 7 is a cross-sectional view of the wing taken along the line 7—7 of FIG. 6.

For airborne use, slots are well suited for the side-looking scannable antenna array, since the cavities can be recessed in or directly mounted to the skin of the airplane fuselage. The array configuration of FIG. 2, on the other hand, is well suited for placement inside an aircraft wing at the leading and trailing edges, thus constituting both forward and rearward-looking arrays capable of being scanned at angles of ±45° from the aircraft axis. FIGS. 6 and 7 illustrate such an installation.

Turning first to FIG. 6, the end of an aircraft wing 47 is shown with the top surface cut-away to reveal the antenna. Here, the antenna comprises two vertically stacked arrays for greater vertical directivity. The top array is comprised of a series of hooked-end drivers 53 spaced apart along the wing axis, forwardly spaced tuned parasitic directors 54, 55, all of which are associated with a reflector 52 that is common to both the top and bottom arrays. The bottom array employs an identical series of drivers 63, tuned directors 64 and directors 65, whereas common front director elements 66 are shared by both the top and bottom arrays.

The aft-scanning antenna is similarly constructed. The top array of this antenna includes common reflector 68, hooked-end drivers 69, tuned directors 70 and second directors 71. The bottom array is constituted of identical drivers 73, tuned directors 74 and second directors 75. Rear-most director 77 is shared by both aft-scanning arrays, which are vertically stacked for vertical directivity.

In the wing shown, the load-bearing wing box 80 is the only major metal-containing area in the immediate vicinity of the atennas, and the leading and trailing edge segments of the wing are formed of non-metallic radomes 81, 82 which do not form undesired ground planes. These radomes may be constructed from fiberglass, Teflon or other rigid non-metallic compositions well known in the art. Desirably, the individual components of the array, and particularly the directors, can be affixed directly to the interior surface of the radomes.

Although the invention has been described with reference to specific preferred embodiments, certain modifications and variations are possible without departing from the invention. Thus, changes in relative dimensions of the individual array elements can be foreseen, as where different scan angles are needed or where less than optimum performance characteristics can be tolerated. Where the antenna system is used on aircraft, it may be mounted in any airfoil, such as the wing, stabilizer or rudder, or in a portion of the fuselage.

What we claim is:

1. In a scannable antenna array for the transmission and/or reception of energy of wavelength λ, having a mutually spaced plurality of endfired Yagi elements each comprising a reflector, a driver and at least one director spaced forwardly therefrom, the improvement wherein:

said driver is a dipole radiator including a pair of radiating conductors each having a forward radiating segment generally perpendicular to the Yagi axis and an inwardly turned end segment behind said forward segment and parallel thereto so that the tips of said pair of radiating conductors are mutually facing, whereby radiation from the tips of said end segments tends to cancel and whereby radiation from said radiating conductors tends to be concentrated near the axis of said driver thereby to reduce radiation coupled from said driver to adjacent elements of the array, the drivers of said mutually spaced elements being disposed such that the forwardly radiating segments are substantially colinear, said Yagi elements being spaced and dimensioned to produce an in-array E-plane directional pattern having a half-power beamwidth of at least ±45° and minimum gain at about ±90°, relative to said axis.

2. The antenna array of claim 1, wherein said radiating conductors are less than 0.5λ in length.

3. The antenna array of claim 2, wherein said Yagi elements are mutually spaced apart center-to-center by about 0.5λ.

4. The antenna array of claim 2, wherein the radiating conductors of each said driver include a conductor segment intermediate said forward radiating segment and said inwardly turned end segments, said intermediate segment having a length substantially less than 0.25λ.

5. The antenna array of claim 4, wherein said intermediate radiating conductor segment is less than about 0.1λ in length.

6. The antenna array of claim 2, wherein said forward radiating conductor segment is less than 0.25λ in length.

7. The antenna array of claim 1, wherein the forward radiating conductor segment of said drive is spaced forwardly of said reflector by less than 0.25λ.

8. The antenna array of claim 7, wherein the spacing between said reflector and said forward radiating conductor segment is about 0.2λ.

9. The antenna array of claim 1, wherein: said director is spaced forwardly of said driver by such distance and is of such dimension that energy received from its associated driver and coupled to the driver of an adjacent Yagi element in the array is substantially equal in intensity and opposite in electrical phase relative to radiation received at said adjacent driver from said associated driver.

10. The antenna array of claim 9, wherein said director is a rod director between 0.25λ and 0.5λ in length.

11. The antenna array of claim 10, wherein said director is spaced forwardly of said forward radiating segment of the driver by less than 0.25λ.

12. The antenna array of claim 9, wherein the forward radiating conductor segment of said driver is spaced substantially equidistantly from said common reflector and said director.

13. The antenna array of claim 9, wherein said director is spaced forwardly of its associated driver by such distance and is so dimensioned that energy received from said associated driver and coupled to the driver of an adjacent element substantially cancels radiation received at said adjacent driver from said associated driver.

14. The antenna array of claim 13, said array being scannable over a total angle of about 90°, wherein the Yagi elements are mutually spaced apart by about 0.54λ.

15. In an antenna array, for the transmission or reception of energy of wavelength λ, having a mutually spaced plurality of end-fired Yagi type elements and each comprising a reflector, a driver spaced forwardly of the reflector and at least one rod director spaced forwardly of said driver, the improvement wherein:

said driver is a dipole radiator having inwardly turned end segments of which the remote ends are mutually facing, said director is spaced forwardly of the associated driver for that element by such distance and is of such length that energy received from said associated driver and coupled to the driver of an adjacent element in the array is substantially equal in intensity and opposite in electrical phase relative to radiation coupled into said adjacent driver from said associated driver, and each of said Yagi elements is spaced and dimensioned to produce an in-array E-plane directional pattern having a half-power bandwidth of at least ±45° and minimum gain at about ±90° relative to said Yagi axis.

16. An airborne scannable antenna system for the transmission or reception of energy of wavelength λ, and adapted for use in airfoil aircraft, comprising a linear antenna array at the interior of the airfoil, said array having:

a plurality of mutually spaced Yagi endfire elements located at the interior of the airfoil and each comprising a reflector, a driver and at least one director associated therewith, said reflector, driver and director being in mutually spaced, generally parallel relation, said drivers each being comprised of a dipole radiator having a pair of radiating conductors formed to have a forward radiating segment and an inwardly turned end segment behind the forward segment and parallel thereto so that the tips of said radiating conductors are mutually facing, said Yagi elements in array generating a radiation pattern having a half-power beamwidth of not less than about ±45° relative to the element axis.

17. The airborne scannable antenna system of claim 16, further comprising:

a second colinear antenna array at the interior of the airfoil having like Yagi end-fire elements spaced for the first array in a direction normal to the plane of said first array.

18. The airbonre scannable antenna system for claim 16, wherein:

said reflector is common to said elements and extends generally in the direction of the axis of the aircraft airfoil.

19. The airborne scannable antenna system of claims 11, 17 or 18 wherein:

said directors are spaced from said drivers and are of such dimension that energy received from associated drivers and coupled to adjacent drivers in the array substantially cancels radiation coupled directly from said associated drivers to said adjacent drivers.

20. The airborne scannable antenna system of claim 16, further comprising:

a non-metallic radome forming a portion of the airfoil and providing a surface through which radiation from said array may be received and/or transmitted, said directors being mounted to said radome at the interior thereof.

21. The airborne scannable antenna system of claim 17, further comprising:

a common parasitic director spaced generally equidistantly between said first and second arrays and forwardly of the directors thereof.

22. The airborne scannable antenna system of claim 16, wherein said director is a rod type director.

23. An antenna for conformal mounting on or within an aircraft airfoil for transmitting and receiving radio frequency signals of wavelength λ and being electronically scannable in the E-plane of radiation, comprising:

an array of end-fire Yagi elements having an inter-element axis to axis spacing of less than about 0.6λ, each Yagi element comprising a reflector, a driver and at least one director spaced from said driver in the direction of transmission of radiation from the antenna, said driver comprising a dipole radiator having a forward radiating segment and a pair of end segments which are inwardly turned to have the tips thereof mutually facing, said forward radiating segments of said Yagi elements of the array being generally co-linear, each said director having a length and a spacing from its associated driver such that the net radio frequency energy coupled into adjacent drivers from said associated driver is substantially reduced thereby, said Yagi elements each producing an in-array E-plane directional pattern having a half-power beamwidth of not less than ±45° and a minimum gain at about ±90° relative to the axis of said Yagi element; and means for connecting said Yagi elements to electronic scanning means for angularly scanning the resultant radio frequency beam of said array in the E-plane.

24. An antenna for conformal mounting on or within an aircraft airfoil for transmitting or receiving radio frequency signals of wavelength λ and being electronically scannable in the E-plane of radiation, comprising:

an array of end-fire Yagi elements having an inter-element axis-to-axis spacing of less than about 0.6λ, each Yagi element comprising a reflector, a driver and at least one rod director spaced from said driver by less than about 0.25λ in the direction of the far field for said antenna;

said driver comprising a dipole radiator having a forward radiating segment not more than 0.25λ in length and a pair of end segments not more than about 0.25λ in length which are inwardly turned to have the tips thereof mutually facing, said forward radiating segments of said Yagi elements of the array being generally colinear, the inter-element coupling between adjacent drivers being not greater than about −15 db, each said director being between 0.25λ and 0.50λ in length and spaced from its associated driver such that the net interelement coupling is substantially reduced thereby, said Yagi elements each producing an in-array E-plane directional pattern having a half-power bandwidth of not less than ±45° and a minimum gain at about ±π° relative to the axis of said Yagi element; and means for connecting said Yagi elements to electronic scanning means for scanning the resultant radio frequency beam of said array over an angle of ±45° relative to the longitudinal beam axis in the E-plane.

25. Apparatus according to claim 24 each Yagi element further comprising:

a second director shorter in length than said first director and spaced forwardly therefrom by less than 0.5λ.

* * * * *